US010851553B2

(12) United States Patent
Dunn et al.

(10) Patent No.: US 10,851,553 B2
(45) Date of Patent: Dec. 1, 2020

(54) BAR ASSEMBLY

(71) Applicant: Erwin Penland LLC, Greenville, SC (US)

(72) Inventors: Karl Dunn, Greenville, SC (US); Seth Hunt, Greenville, SC (US)

(73) Assignee: Erwin Penland LLC, Greenville, SC (US)

( * ) Notice: Subject to any disclaimer, the term of this patent is extended or adjusted under 35 U.S.C. 154(b) by 0 days.

(21) Appl. No.: 16/421,349

(22) Filed: May 23, 2019

(65) Prior Publication Data

US 2019/0360222 A1 Nov. 28, 2019

Related U.S. Application Data

(60) Provisional application No. 62/675,887, filed on May 24, 2018.

(51) Int. Cl.

| | |
|---|---|
| ***E04H 1/00*** | (2006.01) |
| ***E04H 1/12*** | (2006.01) |
| ***A47F 9/00*** | (2006.01) |

(52) U.S. Cl.

CPC ..... *E04H 1/1222* (2013.01); *A47F 9/00* (2013.01)

(58) Field of Classification Search

None

See application file for complete search history.

(56) References Cited

U.S. PATENT DOCUMENTS

| | | | | | |
|---|---|---|---|---|---|
| 282,794 | A * | 8/1883 | Starling | F24F 13/20 | 312/100 |
| 2,836,860 | A * | 6/1958 | Staropoli | E04B 1/34326 | 52/32 |
| 2,966,772 | A * | 1/1961 | Markau | B65B 67/10 | 53/391 |
| 3,140,133 | A * | 7/1964 | Kraft | A47B 69/00 | 312/140.2 |
| 3,160,451 | A * | 12/1964 | Lewis | A47B 49/004 | 312/196 |
| 3,257,760 | A * | 6/1966 | Calthorpe | B60P 3/34 | 52/68 |
| 3,546,827 | A * | 12/1970 | Demarais | E04B 1/34363 | 52/29 |
| 3,694,974 | A * | 10/1972 | Eckel | E04B 1/8218 | 52/36.2 |

(Continued)

*Primary Examiner* — Basil S Katcheves

(74) *Attorney, Agent, or Firm* — Davis Wright Tremaine LLP; George C. Rondeau, Jr.; Heather M. Colburn

(57) ABSTRACT

A bar assembly configured to transition between a bar configuration in which the bar assembly forms a bar structure and a box configuration in which the bar assembly forms a closed container. The bar assembly includes a base portion, lid portion, roof assembly, and bar. The base portion defines an upwardly opening interior area. The lid portion is configured to pivot between open and closed positions. The lid portion covers the interior area when in the closed position. Together, the base and lid portions define the closed container when the lid portion is in the closed position. The roof assembly includes an interior covering configured to be connected to the lid portion when the lid portion is in the open position. The bar is configured to be connected to the base portion. Together, the bar, the base portion, the lid portion, and the roof assembly define the bar structure.

18 Claims, 10 Drawing Sheets

(56) References Cited

U.S. PATENT DOCUMENTS

| | | | | | |
|---|---|---|---|---|---|
| 4,974,500 | A * | 12/1990 | Boyd | A47B 31/02 | 221/96 |
| 5,285,604 | A * | 2/1994 | Carlin | B60P 3/14 | 52/143 |
| 5,802,778 | A * | 9/1998 | Thorp | E04H 15/008 | 52/36.2 |
| 5,915,602 | A * | 6/1999 | Nelson | B67D 1/06 | 108/143 |
| 8,601,956 | B2 * | 12/2013 | Ceballos-Godefroy | A47F 5/10 | 108/170 |
| 2002/0060510 | A1 * | 5/2002 | Choi | A47B 37/04 | 312/6 |
| 2005/0006422 | A1 * | 1/2005 | Catt | A47F 9/00 | 222/609 |
| 2007/0267452 | A1 * | 11/2007 | Hatton | A47F 9/00 | 222/608 |
| 2009/0145050 | A1 * | 6/2009 | Dugand | A47B 47/0041 | 52/36.1 |
| 2009/0249588 | A1 * | 10/2009 | DeMars | A47F 9/00 | 24/457 |
| 2010/0147197 | A1 * | 6/2010 | Chen | A47B 3/0915 | 108/36 |
| 2011/0204756 | A1 * | 8/2011 | DeMars | A47F 9/00 | 312/140.2 |
| 2013/0206044 | A1 * | 8/2013 | Hesselmann | A47F 9/00 | 108/179 |
| 2017/0042325 | A1 * | 2/2017 | Tulli | A47B 3/10 | |
| 2018/0084929 | A1 * | 3/2018 | Papic | A47F 9/00 | |

* cited by examiner

BAR ASSEMBLY

CROSS REFERENCE TO RELATED APPLICATION(S)

This application claims the benefit of U.S. Provisional Application No. 62/675,887, filed on May 24, 2018, which is incorporated herein by reference in its entirety.

BACKGROUND OF THE INVENTION

Field of the Invention

The present invention is directed generally to manufactured buildings and enclosures.

Description of the Related Art

Establishments that serve alcohol, such as bars and taverns, are typically constructed on site. Thus, building a bar normally requires significant financial investment and set up time.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1:
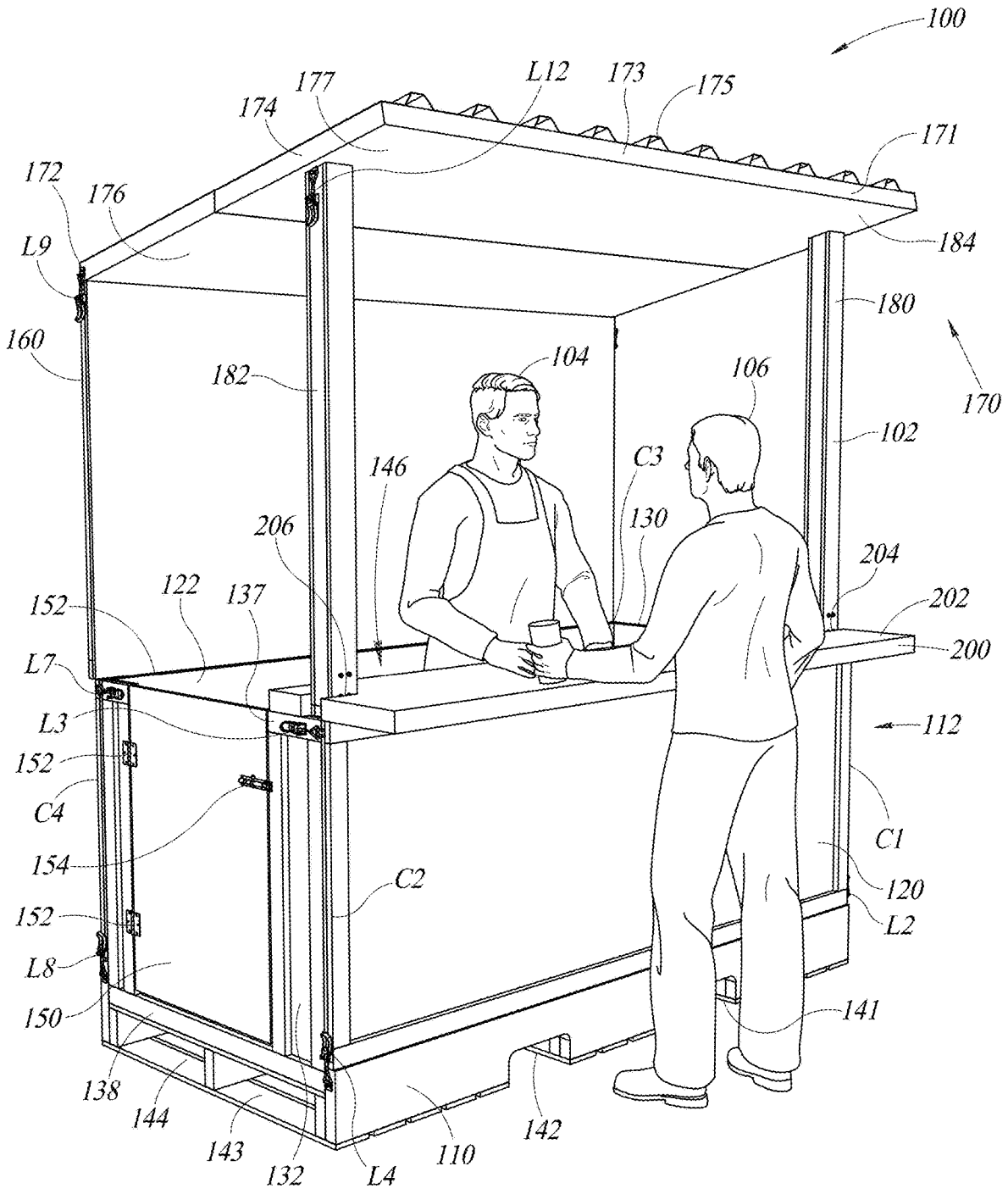
FIG. 1 is a perspective front side view of a collapsible bar assembly depicted in a bar configuration.

FIG. 1 is a perspective view of a collapsible bar assembly 100 depicted in its bar configuration. When in the bar configuration, the assembly 100 defines a partially enclosed structure 102. The structure 102 is a functional piece of furniture configured to be quickly deployed and used as a functional tavern or bar at a location or setting of its owner's choosing. Thus, the assembly 100 reduces or eliminates the financial investment and set up time typically required to construct a tavern or bar. Once deployed, users 104 and 106 may stand within or outside the structure 102 and use the structure 102 as a table, a small kitchen, a back bar, and the like. The structure 102 may be used (e.g., by the user 104) to dispense food and/or drinks (e.g., to the user 106).

Figure 5:
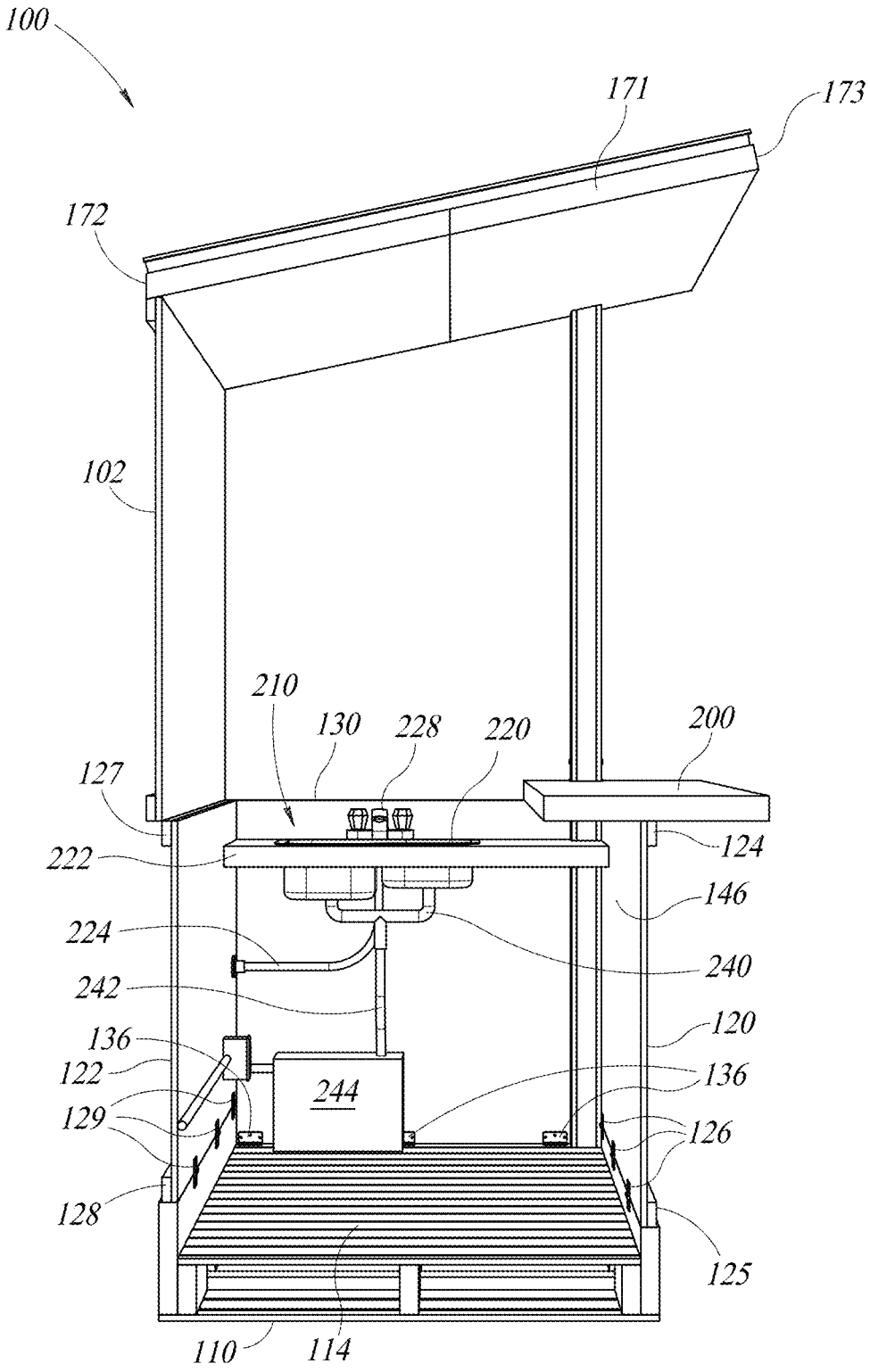
FIG. 5 is a side cross-sectional view of the bar assembly of FIG. 1 depicted in the bar configuration.
Figure 6:
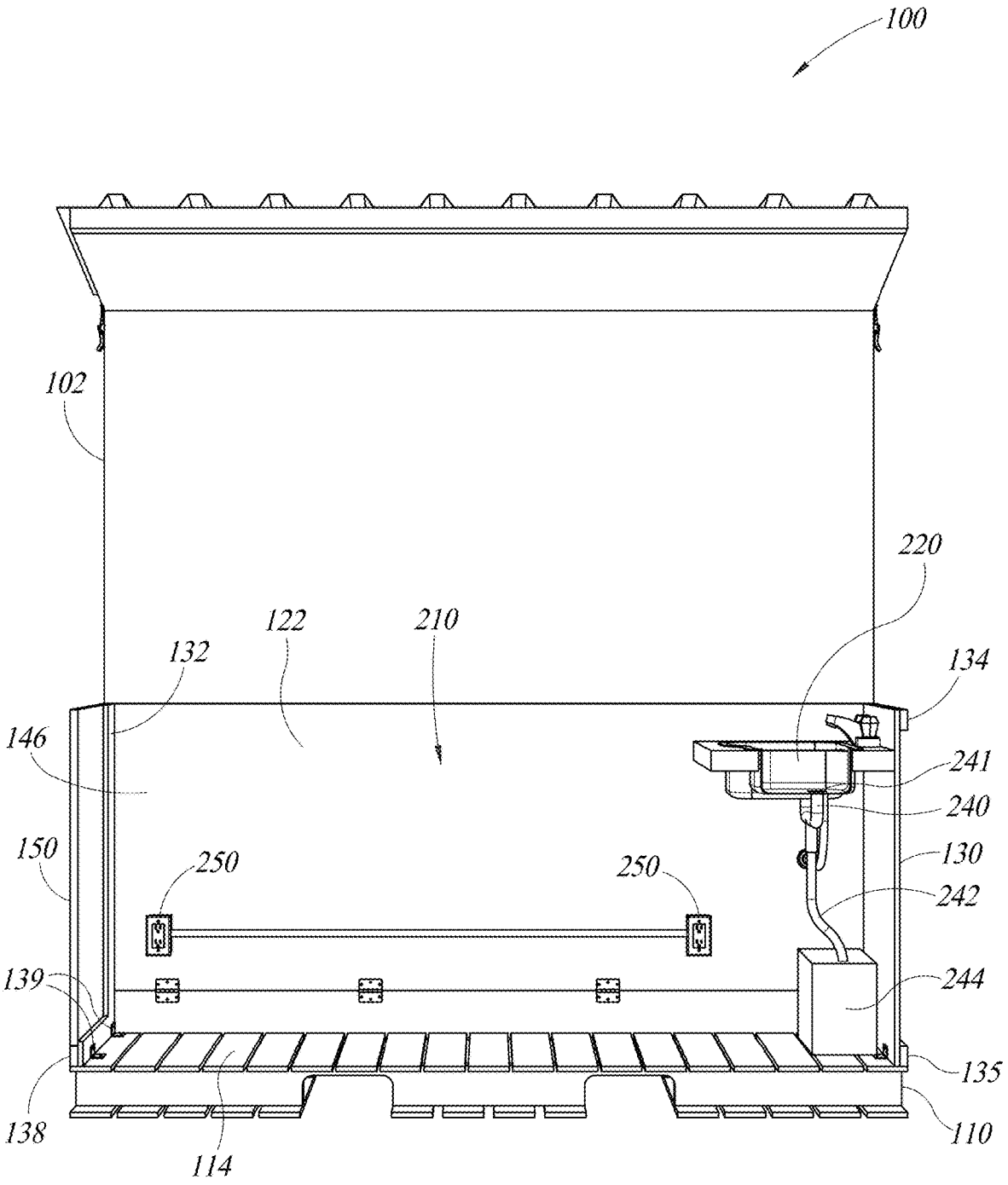
FIG. 6 is a front cross-sectional view of the bar assembly of FIG. 1 depicted in the bar configuration.

The assembly 100 has a bottom portion 110 coupled sidewalls 112. In the embodiment illustrated, the sidewalls 112 include front, back, first side, and second side panels 120, 122, 130, and 132. The bottom portion 110 has an upward facing support surface 114 (see FIGS. 5 and 6) configured to be stood and walked upon by the user 104. Referring to FIGS. 5 and 6, the support surface 114 may be discontinuous and formed by a plurality of boards, planks, and the like. The support surface 114 functions as a floor of the structure 102.

Referring to FIG. 1, in the embodiment illustrated, the front, back, first side, and second side panels 120, 122, 130, and 132 are removably affixed to the bottom portion 110. However, in alternate embodiments, one or more of the panels 120, 122, 130, and 132 may be permanently affixed to the bottom portion 110.

Referring to FIG. 5, the front panel 120 has an upper portion 124 opposite a lower portion 125. The lower portion 125 may be pivotably connected to the bottom portion 110 by one or more hinges 126 that allow the front panel 120 to rotate between an upright deployed position (see FIGS. 1, 5, 7-9B, and 10) and a folded position (see FIG. 9C). Referring to FIG. 1, the front panel 120 may be secured or locked into the deployed position by one or more latches L2 and L4. In the embodiment illustrated, the latches L2 and L4 latch the front panel 120 to the bottom portion 110 in the upright deployed position.

Figure 2:
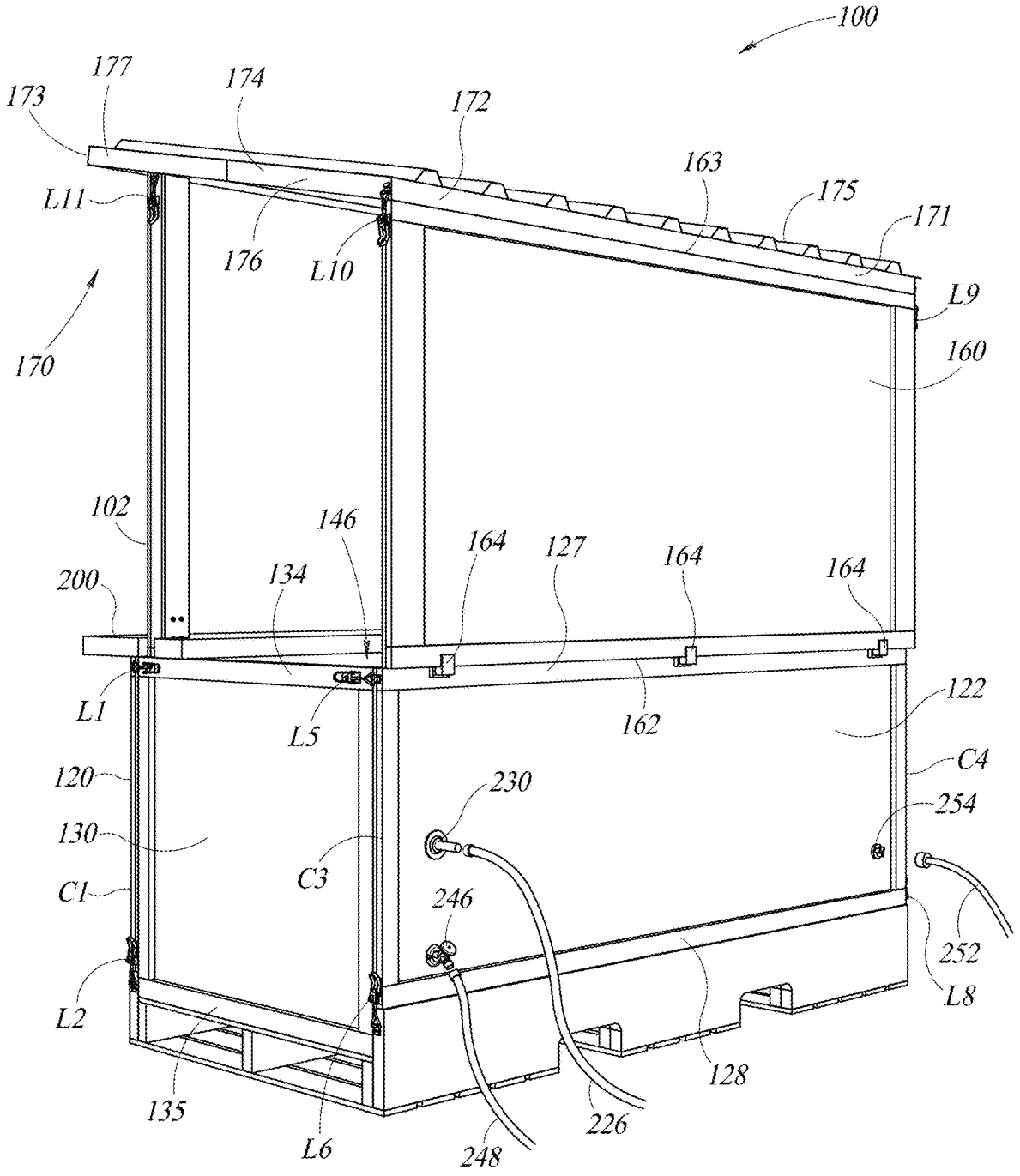
FIG. 2 is a perspective back side view of the bar assembly of FIG. 1 depicted in the bar configuration.

Referring to FIG. 5, the back panel 122 has an upper portion 127 opposite a lower portion 128. The lower portion 128 may be pivotably connected to the bottom portion 110 by one or more hinges 129 that allow the back panel 122 to rotate between an upright deployed position (see FIGS. 1-3, and 5-9B) and a folded position (see FIG. 9C). Referring to FIG. 2, the back panel 122 may be secured or locked into the deployed position by one or more latches L6 and L8. In the embodiment illustrated, the latches L6 and L8 latch the back panel 122 to the bottom portion 110 in the upright deployed position.

Referring to FIG. 2, the first side panel 130 has an upper portion 134 opposite a lower portion 135. Referring to FIG. 5, the lower portion 135 (see FIG. 2) may be pivotably connected to the bottom portion 110 by one or more hinges 136 (see FIG. 5) that allow the first side panel 130 to rotate between an upright deployed position (see FIGS. 1, 2, and 5-9A) and a folded position (see FIG. 9B). Referring to FIG. 2, the first side panel 130 may be secured or locked into the deployed position by the latches L1 and L5. In the embodiment illustrated, the latches L1 and L5 latch the first side panel 130 to the front panel 120 and the back panel 122, respectively, in the upright deployed position.

Referring to FIG. 1, the second side panel 132 has an upper portion 137 opposite a lower portion 138. Referring to FIG. 6, the lower portion 138 may be pivotably connected to the bottom portion 110 by one or more hinges 139 that allow the second side panel 132 to rotate between an upright deployed position (see FIGS. 1, 3, 6-9A and 10) and a folded position (see FIG. 9B). Referring to FIG. 1, the second side panel 132 may be secured or locked into the deployed position by the latches L3 and L7. In the embodiment illustrated, the latches L3 and L7 latch the second side panel 132 to the front panel 120 and the back panel 122, respectively, in the upright deployed position.

The front and back panels 120 and 122 are substantially parallel and spaced part from one another when they are in the deployed positions. Similarly, the first and second side panels 130 and 132 are substantially parallel and spaced part from one another when they are in the deployed positions. The front and back panels 120 and 122 are substantially orthogonal to the first and second side panels 130 and 132 when they are in the deployed positions. When the first and second side panels 130 and 132 are in the deployed positions, the first and second side panels 130 and 132 each extend between the front panel 120 and the back panel 122. The front panel 120 is joined with the first side panel 130 at a first corner "C1" and the front panel 120 is joined with the second side panel 132 at a second corner "C2." Similarly, referring to FIG. 2, the back panel 122 is joined with the first side panel 130 at a third corner "C3" and the back panel 122 is joined with the second side panel 132 (see FIGS. 1, 3, and 6-10) at a fourth corner "C4." The first side panel 130 may be secured (e.g., by the latches L1 and L5) to the front and back panels 120 and 122 at the corners "C1" and "C3," respectively. Referring to FIG. 1, the second side panel 132 may be secured (e.g., by the latches L3 and L7) to the front and back panels 120 and 122 at the corners "C2" and "C4," respectively.

Figure 7:
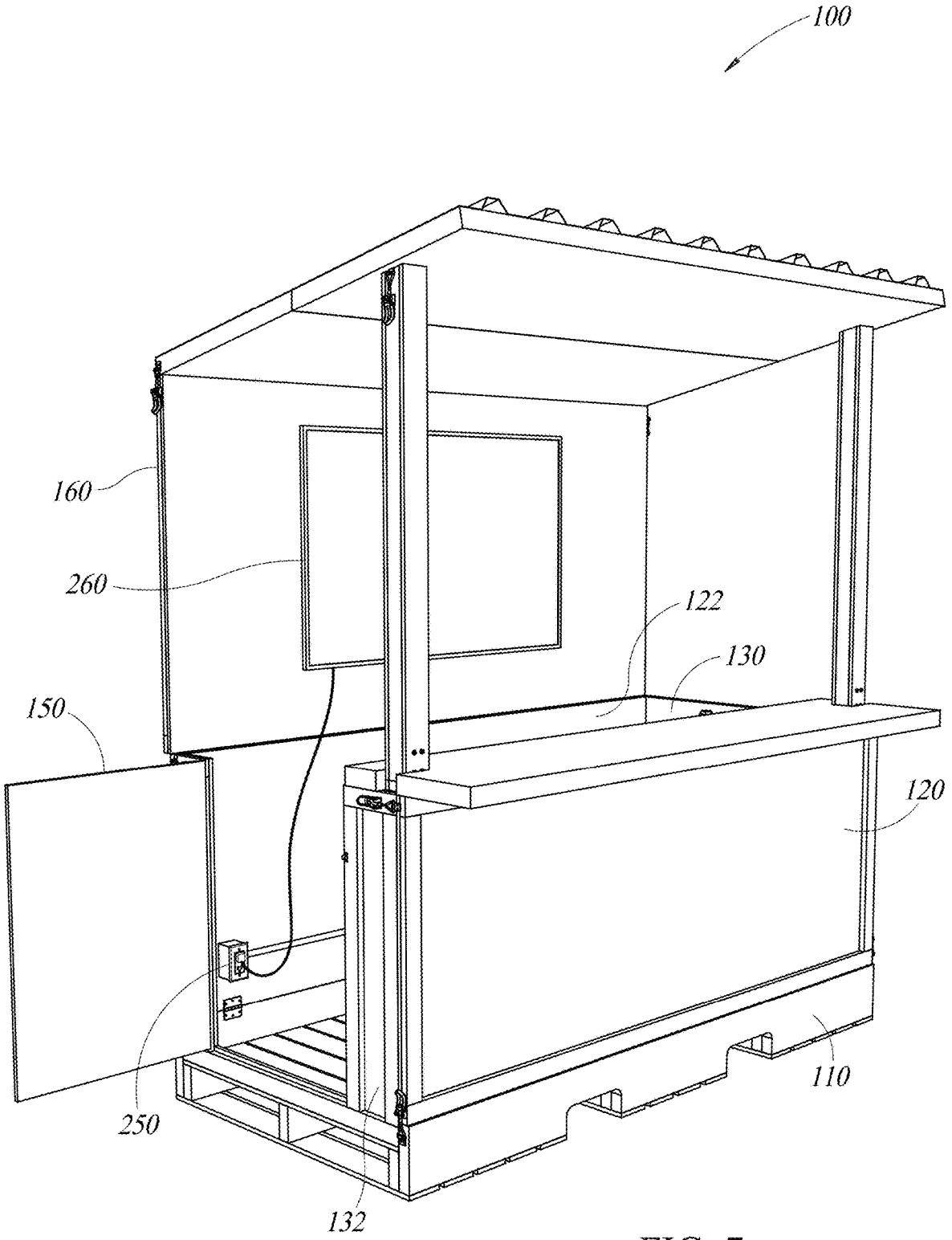
FIG. 7 is a perspective front side view of the bar assembly of FIG. 1 depicted with a Liquid Crystal Display ("LCD") installed therein.
Figure 8:
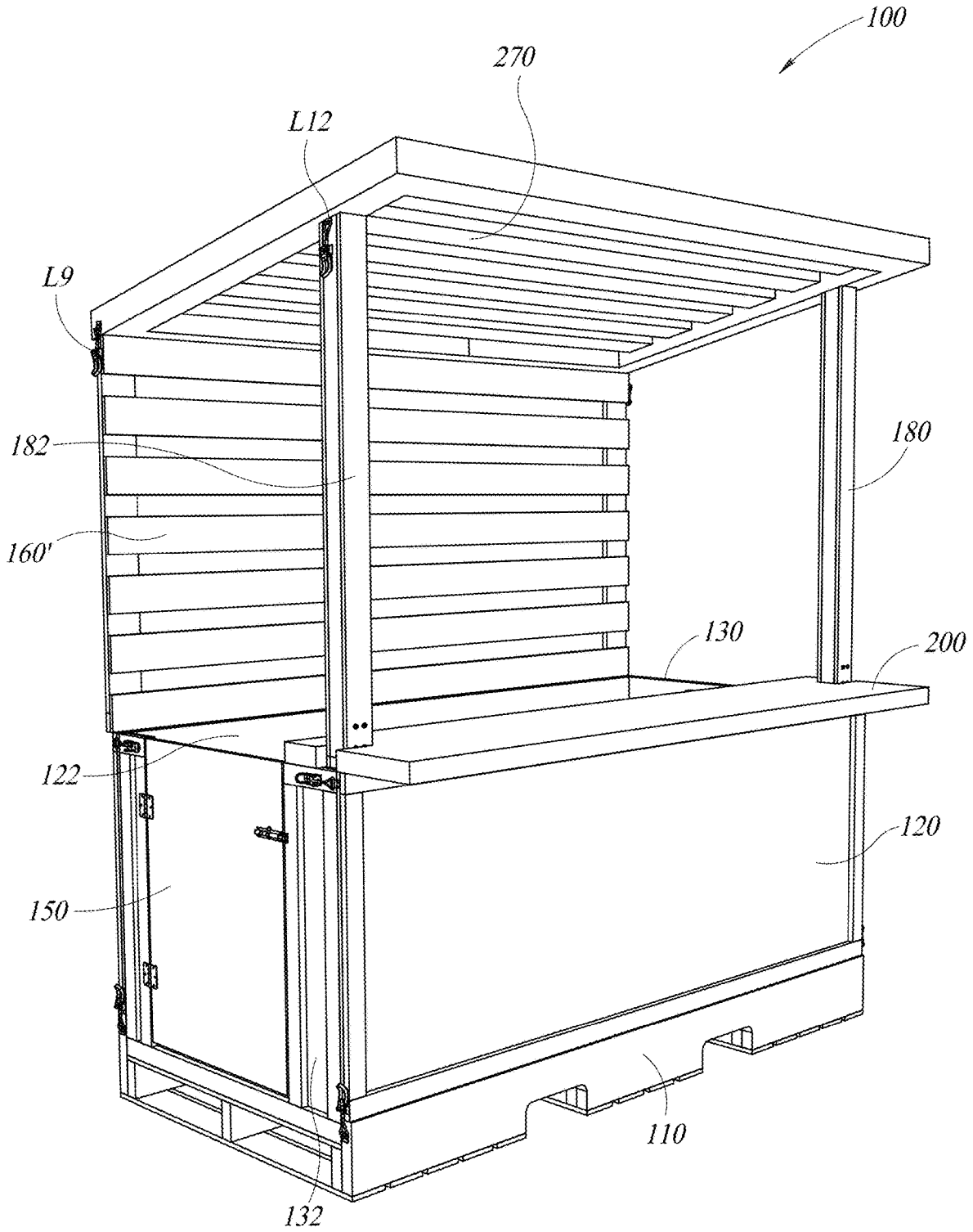
FIG. 8 is a perspective front side view of an alternate embodiment of the bar assembly depicted in the bar configuration.
Figure 9A:
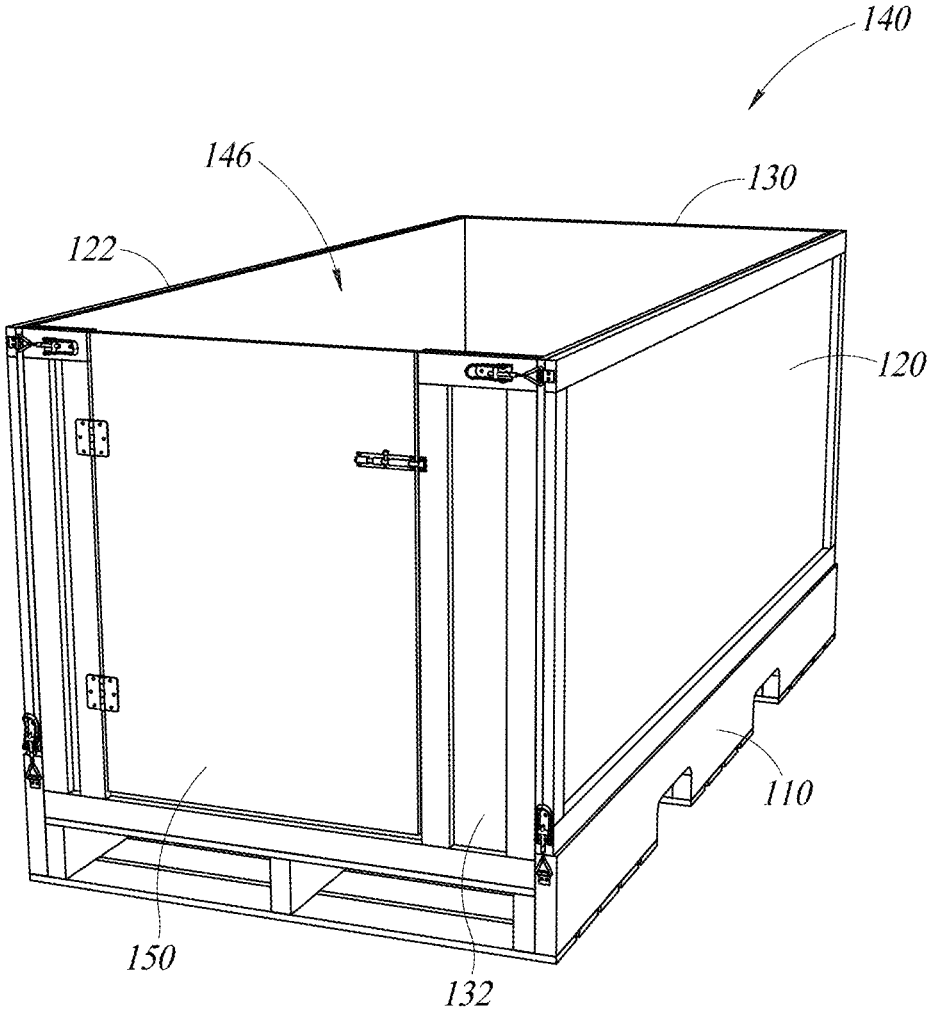
FIG. 9A is a perspective side view of a base portion of the bar assembly of FIG. 1.
Figure 9B:
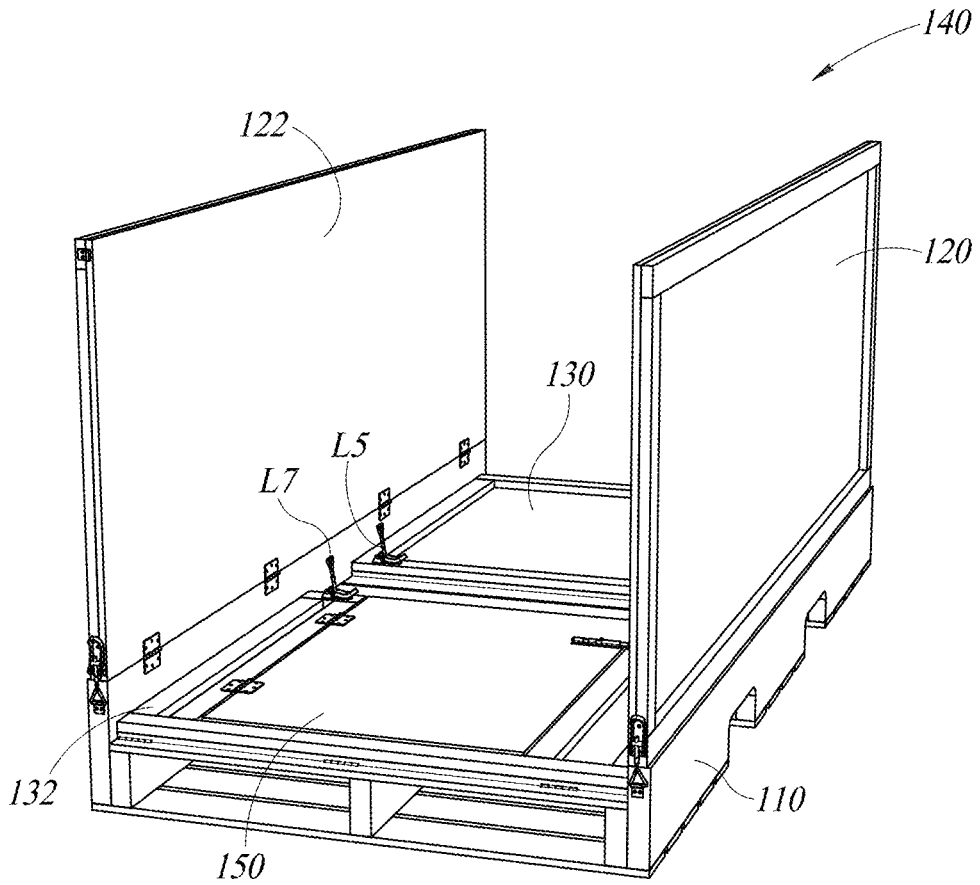
FIG. 9B is a perspective side view of the base portion of FIG. 9A illustrated with its side panels folded inwardly and resting on a bottom portion.
Figure 9C:
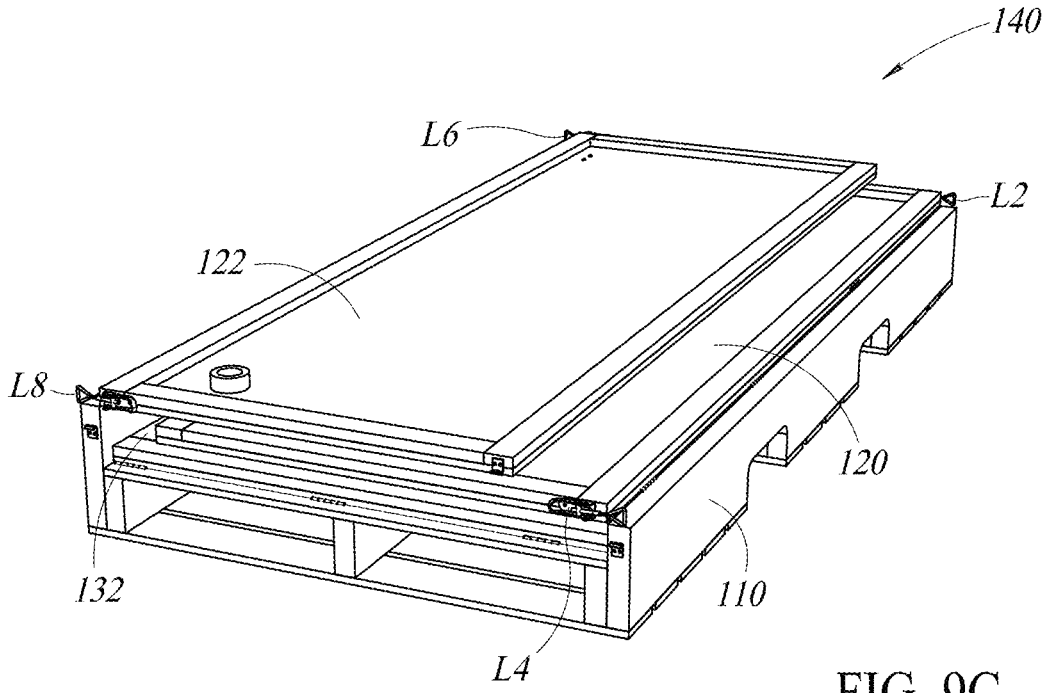
FIG. 9C is a perspective side view of the base portion of FIG. 9A illustrated with all of its panels folded inwardly and resting on the bottom portion.

As shown in FIG. 9A, the front, back, first side, and second side panels 120, 122, 130, and 132 each in the upright deployed position and the bottom portion 110 are configured to be assembled together into a base portion 140 of the bar configuration (see FIGS. 1, 2, and 5-8). In the embodiment illustrated, the base portion 140 is configured to be transitioned into a flat configuration for shipping. Referring to FIG. 9B, the base portion 140 is transitioned to the flat configuration by unlatching the latches L1 (see FIG. 2) and L5 and rotating the first side panel 130 inwardly on the hinge(s) 136 (see FIG. 5) from the deployed position to the folded position. The latches L3 (see FIG. 1) and L7 are also unlatched and the second side panel 132 is rotated inwardly on the hinge(s) 139 (see FIG. 6) from the deployed position to the folded position. Next, referring to FIG. 9C, the latches L2 and L4 are unlatched and the front panel 120 is rotated inwardly on the hinge(s) 126 (see FIG. 5) from the deployed position to the folded position. The latches L6 and L8 are also unlatched and the back panel 122 is rotated inwardly on the hinge(s) 129 (see FIG. 5) from the deployed position to the folded position. Thus, as shown in FIG. 9C, with the latches L1-L8 unlatched, the base portion 140 may be transitioned into the flat configuration by rotating the first side panel 130 to the folded position, rotating the second side panel 132 to the folded position, rotating the front panel 120 to the folded position, and rotating the back panel 122 to the folded position.

After the flat configuration is located at a desired location, referring to FIG. 9A, the front, back, first side, and second side panels 120, 122, 130, and 132 may be rotated outwardly to their deployed positions and latched to form the base portion 140. In the embodiment illustrated, the lower portions 125 and 128 (see FIG. 5) of the front and back panels 120 and 122 are offset vertically from the lower portions 135 and 138 (see FIG. 6) of the first and second side panels 130 and 132 to provide enough clearance to allow the front and back panels 120 and 122 to be folded on top of the first and second side panels 130 and 132 as illustrated in FIG. 9C.

Referring to FIG. 9A, an upwardly opening interior area 146 is defined inside the base portion 140 when the front, back, first side, and second side panels 120, 122, 130, and 132 are in the deployed positions. In FIG. 1, the user 104 is illustrated standing on the support surface 114 (see FIGS. 5 and 6) inside the interior area 146.

The bottom portion 110 may include slots or openings 141-144 each configured to receive one of a pair of forks (not shown) of the type typically included on a forklift (not shown), a pallet jack (not shown), or the like. Thus, the bottom portion 110 may be configured to be picked up by the forks so that the assembly 100 may be moved by the forklift, pallet jack, or the like as a unit. The assembly 100 may be moved in this manner when the assembly 100 is in the bar configuration or a box configuration (see FIG. 10). Additionally, the base portion 140 (see FIG. 9A) may be moved in this manner when in the configuration of FIG. 9A or the flat configuration illustrated in FIG. 9C. In other words, the assembly 100 or a portion thereof including the bottom portion 110 may be moved by a forklift, pallet jack, or the like during shipping. By way of a non-limiting example, the bottom portion 110 may be implemented as a pallet. The bottom portion 110 may be constructed from one or more materials (e.g., treated wood or lumber) that is suitable for outdoor use.

Referring to FIG. 1, at least one of the first and second side panels 130 and 132 may include a door 150 configured to open and close to allow the user 104 to enter and leave the interior area 146 as desired. In the embodiment illustrated, the door 150 is attached to the second side panel 132 by one or more hinges 152. The door 150 is configured to rotate on the hinge(s) 152 between an open position (see FIG. 7) and a closed position (see FIGS. 1, 6, 8, 9A, and 10). The door 150 may be configured to be locked in the closed position by a latch or lock 154.

Figure 3:
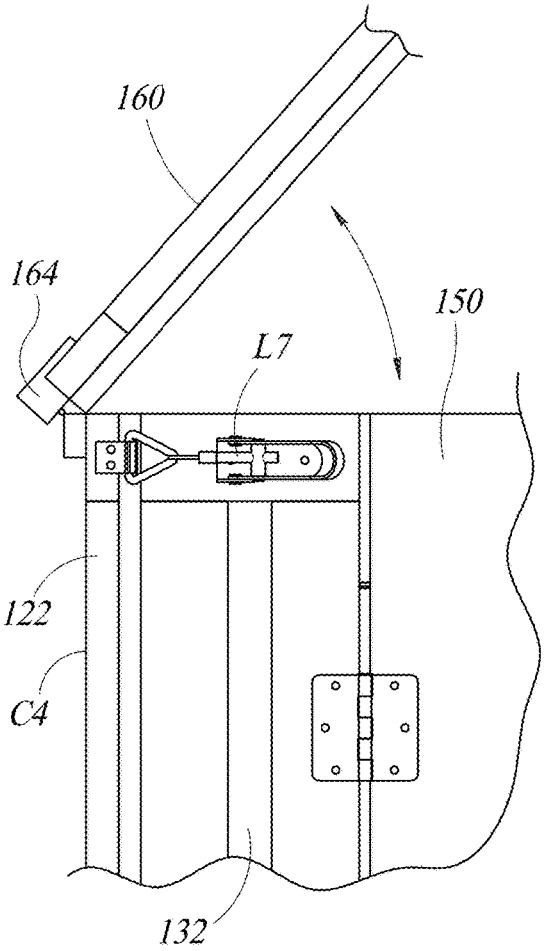
FIG. 3 is a side view of a back corner of the bar assembly of FIG. 1.
Figure 10:
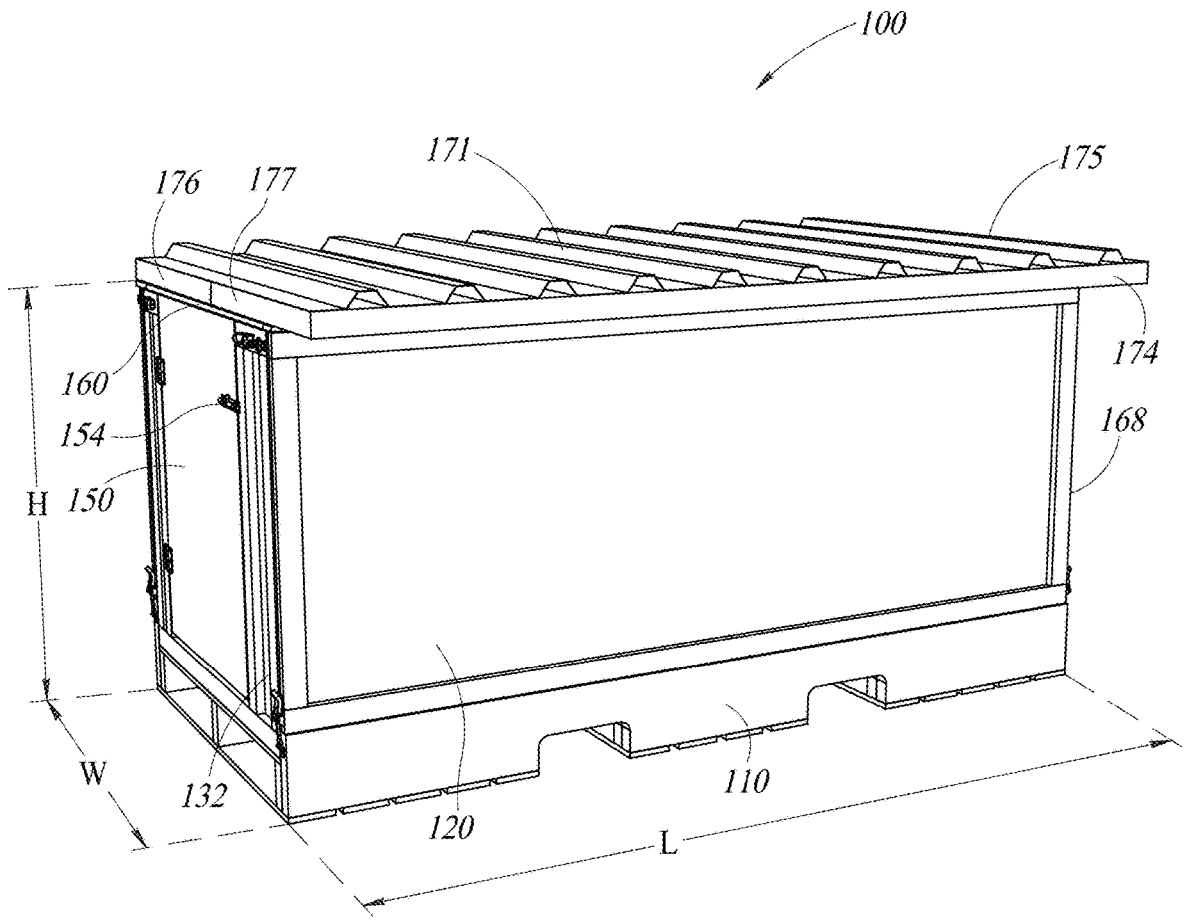
FIG. 10 is a perspective front side view of the bar assembly of FIG. 1 depicted in a box configuration.

Referring to FIG. 2, the assembly 100 includes a lid portion 160 with a first edge portion 162 opposite a second edge portion 163. The first edge portion 162 is pivotably attached to the upper portion 127 of the back panel 122 by one or more hinges 164. Thus, as shown in FIG. 3, the lid portion 160 pivots with respect to the base portion 140 (see FIGS. 9A-9C). Referring to FIG. 2, the hinge(s) 164 may each be implemented as a slip hinge that is configured to allow the lid portion 160 to close down on the upper portions 124, 127, 134, and 137 of the front, back, first side, and second side panels 120, 122, 130, and 132, respectively. The lid portion 160 pivots with respect to the base portion 140 (see FIGS. 9A-9C) between an open position (see FIGS. 1, 2, and 7) and a closed position (see FIG. 10). When the lid portion 160 is in the open position, the lid portion 160 may function as a back wall that extends upwardly from the back panel 122. On the other hand, when the lid portion 160 is in the closed position, the lid portion 160 covers the interior area 146 and rests upon at least one of the upper portions 124, 127, 134, and 137 of the front, back, first side, and second side panels 120, 122, 130, and 132, respectively. Thus, referring to FIG. 10, together the lid portion 160, the bottom portion 110, and the front, back, first side, and second side panels 120, 122, 130, and 132 define a closed box or container 168 when the lid portion 160 is in the closed position. FIG. 10 illustrates the assembly 100 in the box configuration.

Referring to FIG. 2, the assembly 100 includes a removable roof assembly 170 that includes an interior covering 171 configured to at least partially cover the interior area 146. The interior covering 171 has a first edge portion 172 opposite a second edge portion 173. The first edge portion 172 is configured to be attached to the second edge portion 163 of the lid portion 160. The lid portion 160 functions as a support for the interior covering 171 and positions the interior covering 171 above the interior area 146. The second edge portion 163 may be attached to the first edge portion 172 by one or more latches L9 and L10 (e.g., draw latches). In the embodiment illustrated in FIG. 2, the interior covering 171 includes a split or divided portion 174 and a roof cover 175. The divided portion 174 includes two or more sections 176 and 177 arranged side-by-side and optionally joined together. The sections 176 and 177 are each configured to be stored in the interior area 146 when the interior covering 171 is detached from the lid portion 160 and the sections 176 and 177 are separated from one another. Each of the sections 176 and 177 may be hollow, partially hollow, or solid. The roof cover 175 is attached to the divided portion 174 with fasteners (e.g., through pins and rubber grommets). The roof cover 175 may be separated from the divided portion 174 so that the sections 176 and 177 may be separated from one another. The roof cover 175 may be constructed from a single sheet or piece of material, such as corrugated plastic roofing material. The roof cover 175 may be waterproof.

Referring to FIG. 1, the roof assembly 170 includes first and second roof supports 180 and 182 configured to support the interior covering 171 above the interior area 146. The first roof support 180 is positioned inside the interior area 146 at the first corner "C1" and the second roof support 182 is positioned inside the interior area 146 at the second corner "C2." In the embodiment illustrated, the first and second roof supports 180 and 182 extend upwardly beyond the lid portion 160 when the lid portion 160 is in the open position (see FIGS. 1, 2, and 7). Thus, the second edge portion 173 of the interior covering 171 is positioned above the first edge portion 172 of the interior covering 171 allowing rain to run off the interior covering 171 toward the back of the structure 102. In other words, the interior covering 171 is other than flat. Thus, the interior covering 171 is other than parallel with respect to the support surface 114 (see FIGS. 5 and 6). By way of a non-limiting example, the structure 102 may have a first height of about seven feet from the ground to the top of the interior covering 171 at the first edge portion 172, and a second height of about seven feet and ten inches from the ground to the top of the interior covering 171 at the second edge portion 173. The interior covering 171 may have a width of about four feet and two inches between the first and second edge portions 172 and 173. In the embodiment illustrated, the interior covering 171 extends frontwardly beyond the first and second roof supports 180 and 182.

An underside 184 of the interior covering 171 rests upon the roof supports 180 and 182. The interior covering 171 may be attached to the roof supports 180 and 182 (e.g., with latches L11 (see FIG. 2) and L12, respectively). The first roof support 180 may be attached to the front panel 120 and/or the first side panel 130 with removable fasteners (e.g., bolts). Similarly, the second roof support 182 may be attached to the front panel 120 and/or the second side panel 132 with removable fasteners (e.g., bolts).

Figure 4:
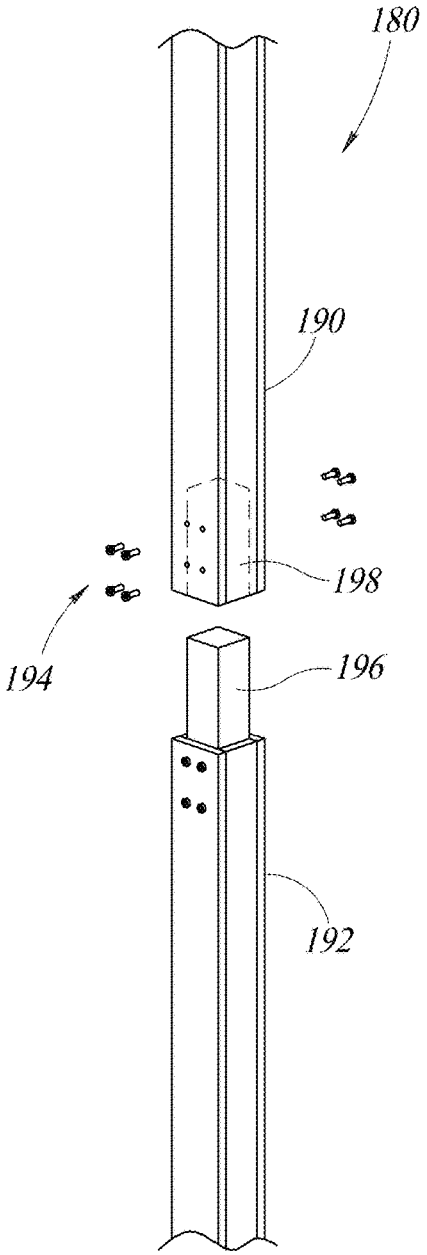
FIG. 4 is an exploded perspective view of a roof support of the bar assembly of FIG. 1.

The first and second roof supports 180 and 182 are substantially identical to one another. Therefore, only the first roof support 180 will be described in detail. However, the description of the first roof support 180 also applies to the second roof support 182. Referring to FIG. 4, each of the roof supports 180 and 182 (see FIGS. 1 and 8) has an upper portion 190 configured to be removably attached to a lower portion 192 by one or more fasteners 194 (e.g., bolts). In the embodiment illustrated, the lower portion 192 has an upwardly extending key portion 196 configured to be received inside a downwardly opening keyway portion 198 of the upper portion 190. The key portion 196 may be implemented as an internal support that extends upwardly and is fastened (e.g., bolted) to the upper portion 190 when the key portion 196 is received inside the keyway portion 198. The upper and lower portions 190 and 192 may be detachable from one another so that they may be packed inside the interior area 146.

Referring to FIG. 1, the assembly 100 includes a removable counter or bar 200 configured to be mounted on the upper portion 124 (see FIG. 5) of the front panel 120. The bar 200 has an upwardly facing serving surface 202 configured to have items placed thereupon. For example, the user 104 may serve drinks and/or food items to the user 106 on the serving surface 202. The bar 200 includes notches 204 and 206 configured to receive the roof supports 180 and 182, respectively, and allow the roof supports 180 and 182 to pass alongside or through the bar 200. The bar 200 may be constructed from one or more suitable materials (e.g., wood, plastic, and the like). As shown in FIG. 1, the second edge portion 173 of the interior covering 171 may extend frontwardly so that the interior covering 171 covers the bar 200 and helps protect the bar 200 (e.g., from falling objects, sun, rain, and the like).

Referring to FIG. 5, the interior area 146 may be outfitted with one or more attachments and/or accessory items. For ease of illustration, the attachments and/or accessory items have been illustrated and will be described as being accessories 210. For example, the accessories 210 may include a sink 220 mounted on a counter 222 positioned inside the interior area 146 and coupled to the base portion (see FIGS. 9A-9C). In the embodiment illustrated, the sink 220 and the counter 222 are coupled to the first side panel 130. However, this is not a requirement.

The sink 220 may be plumbed (e.g., by one or more flexible hoses 224) to a water source 226 (see FIG. 2) configured to provide water to a faucet 228 (e.g., a cold water faucet, a hot water faucet, and the like) installed on the sink 220 and/or the counter 222. The sink 220 may be implemented as a double sink that is surface mounted to the counter 222. The faucet 228 may be implemented as a low profile faucet. Referring to FIG. 2, the water source 226 may be implemented as a hose or pipe (e.g., a garden hose) configured to be coupled to a water inlet 230 installed in the base portion 140 (see FIGS. 9A-9C). In the embodiment illustrated, the water inlet 230 is installed in the back panel 122. Referring to FIG. 5, the water inlet 230 (see FIG. 2) is connected to the faucet 228 (e.g., by the flexible hose(s) 224) and provides water thereto. Once the water source 226 is attached and turned on, the faucet 228 controls water flow into the sink 220.

The sink 220 has a drain 241 connected to drainage plumbing 240 that allows the contents of the sink 220 drain. In the embodiment illustrated, the drainage plumbing 240 includes pipes 242 connected to a drainage tank 244. The drainage tank 244 may be implemented as a three gallon tank to a five gallon tank. The drainage tank 244 may be positioned and/or hidden below the counter 222. Referring to FIG. 2, the drainage tank 244 (see FIGS. 5 and 6) may be connected to a waste water or drain outlet 246 installed in the base portion 140 (see FIGS. 9A-9C). In the embodiment illustrated, the drain outlet 246 is installed in the back panel 122. Water may drain from the internal drainage tank 244 (see FIGS. 5 and 6) through the drain outlet 246. The drain outlet 246 may include a selectively openable and closeable faucet or valve. A water or drainage line 248 may be attached to the drain outlet 246 and positioned to extend away from the structure 102 to allow water draining from the sink 220 to be removed from the immediate vicinity of the structure 102.

Referring to FIG. 6, the accessories 210 may include one or more electrical power outlets 250 configured to be connected to an electrical power source 252 (see FIG. 2). The power outlet(s) 250 may be configured for exterior or outdoor use. Referring to FIG. 2, the power source 252 may be implemented as a power cord (e.g., an extension cord) connected to a standard wall outlet, a portable generator, and the like. An electrical power inlet 254 is installed in the base portion 140 (see FIG. 9A-9C). In the embodiment illustrated, the electrical power inlet 254 is installed in the back panel 122. The electrical power inlet 254 is connected to the power outlet(s) 250 and provides electrical power thereto. The electrical power inlet 254 may be implemented as a male connector or a female connector. A cap (not shown) may be installed on the electrical power inlet 254 when the electrical power inlet 254 is not in use to protect the electrical power inlet 254 from the outside environment (e.g., rain, snow, moisture, and the like).

Referring to FIG. 7, the power outlet(s) 250 may be used to power various electrical devices. For example, the power outlet(s) 250 may power a television or a Liquid Crystal Display ("LCD") 260 that is surface mounted to the lid portion 160. By way of another non-limiting example, the power outlet(s) 250 may be used to power restaurant and/or bar equipment, such as a blender, a refrigerator, a lamp, an overhead light, a cash register, a hot plate, a coffee pot, and the like.

Referring to FIG. 5, the accessories 210 may include other accessories and/or attachments beyond those described herein that enhance the bar experience. For example, the accessories 210 may include one or more lights (not shown) installed in the structure 102. Referring to FIG. 2, the light(s) (not shown) may be connected to the power inlet 254 and receive power therefrom. Referring to FIG. 1, the light(s) (not shown) may be configured to provide light to the interior area 146 and/or the serving surface 202. By way of a non-limiting example, the light(s) (not shown) may be installed in the underside 184 of the interior covering 171. Additionally, one or more speakers (not shown) may be installed on the first roof support 180 and/or the second roof support 182.

FIG. 8 is perspective view of an alternate embodiment of the assembly 100 that includes a slatted lid portion 160' and a slatted roof 270. In this embodiment, the slatted lid portion 160' is installed instead and in place of the lid portion 160 (see FIGS. 1-3, 7, and 10). The slatted lid portion 160' is pivotably connected to the back panel 122 and functions identically to the lid portion 160. Further, the interior covering 171 (see FIGS. 1, 2, 5, and 10) includes the slatted roof 270 instead and in place of the divided portion 174 (see FIGS. 1, 2, and 10) and the roof cover 175 (see FIGS. 1, 2, and 10). As shown in FIG. 8, the slatted roof 270 is supported by the slatted lid portion 160' and the roof supports 180 and 182. The embodiment illustrated in FIG. 8 may provide a more open construction and/or improved high wind tolerance.

From the bar configuration (see FIGS. 1, 2, and 5-8), the assembly 100 may be disassembled and collapsed or folded into the box configuration depicted in FIG. 10. Conversely, from the box configuration (see FIG. 10), the assembly 100 may be unfolded and assembled into the bar configuration (see FIGS. 1, 2, and 5-8).

To transition the assembly 100 from the bar configuration (see FIGS. 1, 2, and 5-8) to the box configuration, the user 104 removes the bar 200 from the front panel 120, detaches the interior covering 171 from the roof supports 180 and 182, detaches the interior covering 171 from the lid portion 160, and detaches the roof supports 180 and 182 from the base portion 140. The user 104 may place the bar 200 inside the interior area 146. The roof supports 180 and 182 may be disassembled and placed inside the interior area 146. Depending on the implementation details, as shown in FIG. 10, the interior covering 171 may be placed on top of the lid portion 160 when the lid portion 160 is in the closed position. Alternatively, the user 104 may at least partially disassemble the interior covering 171. For example, the user 104 may separate the divided portion 174 from the roof cover 175. Further, the user 104 may separate the section 176 from the section 177 and place the sections 176 and 177 inside the interior area 146. The roof cover 175 may be placed on top of the lid portion 160 after the lid portion 160 is in the closed position.

As shown in FIG. 10, the lid portion 160 is folded down and forms a box lid when the assembly 100 is in the box configuration. The interior covering 171 of the roof assembly 170 is detachable and may be placed on top of the lid portion 160 during storage. The front, back, first side, and second side panels 120, 122, 130, and 132 remain latched in their deployed positions when the assembly 100 is in the box configuration. The accessories 210 (see FIGS. 5 and 6) may be stored inside the container 168. For example, the bar 200, the counter 222, and the like may remain or be placed inside the container 168 when the assembly 100 is in the box configuration. Referring to FIG. 10, the door 150 remains operable when the assembly 100 is in the box configuration to provide access to the interior area 146 and any components stored therein.

Referring to FIG. 10, in the box configuration, the assembly 100 may be characterized as forming the container 168, which may be shipped and/or stored. When in the box configuration, the assembly 100 has a box-like outer shape with a length "L," a height "H," and a width "W." By way of non-limiting example, the length "L" may be approximately six feet and ten inches, the height "H" may be approximately three feet and four inches, and the width "W" may be approximately three feet and four inches.

To transition the assembly 100 from the box configuration (see FIG. 10) to the bar configuration (see FIGS. 1, 2, and 5-8), the user 104 removes the interior covering 171 from the lid portion 160 if the interior covering 171 was placed on top of the lid portion 160. Then, referring to FIG. 1, the user 104 pivots the lid portion 160 into the open position. Next, the user 104 removes the first and second roof supports 180 and 182 from the interior area 146. The user 104 may also remove any other components stored inside the interior area 146. The user 104 assembles the first and second roof supports 180 and 182 and installs them in the corners "C1" and "C2," respectively.

At this point, the user 104 may place the bar 200 on the upper portion 124 (see FIG. 5) of the front panel 120 with the first and second roof supports 180 and 182 received inside the notches 204 and 206, respectively. The bar 200 may be fastened to the front panel 120 and/or the first and second roof supports 180 and 182, if desired.

If the interior covering 171 was at least partially disassembled, the user 104 assembles the interior covering 171. For example, the user 104 may attach the section 176 to the section 177 to form the divided portion 174. Then, the user 104 may attach the roof cover 175 to the divided portion 174.

Referring to FIG. 2, the user 104 (see FIG. 1) attaches the first edge portion 172 of the interior covering 171 to the second edge portion 163 of the lid portion 160. In the embodiment illustrated, the user 104 latches the interior covering 171 to the lid portion 160 with the latches L9 and L10. At this point, the underside 184 of the interior covering 171 is resting on the first and second roof supports 180 and 182. Referring to FIG. 1, the user 104 may the latch the interior covering 171 to the first and second roof supports 180 and 182 with the latches L11 (see FIG. 2) and L12, respectively. At this point, referring to FIG. 2, the user 104 may couple the water source 226 to the water inlet 230, the drainage line 248 to the drain outlet 246, and/or the power source 250 to the power inlet 254.

Referring to FIG. 1, the structure 102 may be characterized as being a self-contained bar that transforms into and/or may be at least partially packaged into the container 168 (see FIG. 10) by reconfiguring the structure 102 into the box configuration. When in the box configuration, the assembly 100 may be shipped and transported to its owner. Once the assembly 100 arrives, the owner can reconfigure the box configuration into the bar configuration. The owner may transition the assembly 100 between the bar configuration and the box configuration as many times as is desired.

The base portion 140 (see FIGS. 9A-9C) may be folded into the flat configuration (see FIG. 9C) before the assembly 100 is shipped to the owner. In such embodiments, the roof assembly 170, the lid portion 160, and the accessories 210 (see FIGS. 5 and 6) may be shipped separately or along with the base portion 140. Once the assembly 100 arrives, the owner can construct whichever of the box configuration and the bar configuration is desired. The owner may transition the assembly 100 between the bar configuration and the box configuration as desired.

While prior art modular bars exist, they do not fully utilize a container in a bar configuration. In other words, unlike the assembly 100, prior art modular bars include components that are needed to form the container but are not used in the bar structure. Thus, prior art modular bars include components that do not form part of the bar structure and may be damaged or lost because they are separated from the bar structure.

Referring to FIG. 1, the assembly 100 may be packaged and sold as a kit. In such embodiments, the kit may include the base portion 140 (see FIGS. 9A-9C), the lid portion 160, the roof assembly 170, and the bar 200. Optionally, the kit may include one or more of the accessories 210 (see FIGS. 5 and 6).

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Accordingly, the invention is not limited except as by the appended claims.

The invention claimed is:

1. A bar assembly comprising:

a base portion comprising a front panel and a back panel, an interior area being defined inside the base portion between the front panel and the back panel;

a bar removably couplable to an upper portion of the front panel;

a lid portion having a first end portion pivotably connected to an upper portion of the back panel, the lid portion having a second end portion opposite the first end portion, the lid portion being rotatable between an open position and a closed position; and a roof assembly comprising a first roof support, a second roof support, and an interior covering, the first and second roof supports each being removably couplable to the base portion, the interior covering being removably couplable to the second end portion of the lid portion when the lid portion is in the open position, the interior covering being supportable by the first roof support and the second roof support when the interior covering is coupled to the lid portion, the interior area being at least partially covered by the interior covering when the interior covering is coupled to the lid portion and supported by the first roof support and the second roof support, the bar being storable inside the interior area when the bar is not coupled to the upper portion of the front panel, the second end portion of the lid portion resting on the front panel when the lid portion is in the closed position and the bar is not coupled to the upper portion of the front panel.

2. The bar assembly of claim 1, further comprising:

a sink coupled to the base portion inside the interior area, the sink comprising a drain, the base portion comprising a drain outlet that is connected to the drain and configured to drain waste water from the sink; and a faucet positioned to provide water to the sink, the base portion comprising a water inlet that is connected to the faucet, the water inlet being configured to be connected to a water source, receive water from the water source, and provide the water to the faucet.

3. The bar assembly of claim 2, further comprising:

a counter coupled to the base portion inside the interior area, the sink being mounted to the counter.

4. The bar assembly of claim 1, further comprising:

at least one electrical power outlet coupled to the base portion inside the interior area, the base portion comprising an electrical power inlet configured to receive electrical power from an electrical power source and provide the electrical power to the at least one electrical power outlet.

5. The bar assembly of claim 1, wherein the first and second roof supports each disassemble into components configured to be stored inside the interior area when the lid portion is in the closed position.

6. The bar assembly of claim 1, wherein the interior covering is configured to be placed on top of the lid portion when the lid portion is in the closed position.

7. The bar assembly of claim 1, wherein the base portion comprises a door configured to allow a user to enter and exit the interior area when the door is in an open position.

8. The bar assembly of claim 1, wherein the base portion comprises a first side panel, a second side panel, and a bottom portion, the front, back, first side, and second side panels are each hingedly connected to the bottom portion, and the front, back, first side, and second side panels are configured to fold inwardly toward the bottom portion and into a flat configuration.

9. The bar assembly of claim 8, wherein the bottom portion is a pallet.

10. The bar assembly of claim 1, wherein the base portion comprises a pair of spaced apart openings configured to receive a pair of forks of a forklift or a pallet jack.

11. The bar assembly of claim 1, wherein the base portion comprises a bottom portion with an upwardly facing support surface, and the interior covering is other than parallel with respect to the support surface.

12. The bar assembly of claim 1, wherein the base portion comprises a first side panel and a second side panel, the first and second side panels each extend between the front and back panels, the first roof support is positioned at a first corner defined by the front panel and the first side panel, and the second roof support is positioned at a second corner defined by the front panel and the second side panel.

13. A bar assembly configured to transition between a bar configuration in which the bar assembly forms a bar structure and a box configuration in which the bar assembly forms a closed container, the bar assembly comprising:

a base portion comprising a bottom portion and sidewalls, the sidewalls defining an upwardly opening interior area;

a lid portion having an end portion configured to be pivotably connected to one of the sidewalls, the lid portion being configured to pivot between an open position and a closed position, the lid portion covering the upwardly opening interior area when in the closed position, together the base portion and the lid portion defining the closed container when the lid portion is in the closed position;

a roof assembly comprising an interior covering configured to be connected to the lid portion when the lid portion is in the open position, the roof assembly comprising at least one roof support configured to support the interior covering above the upwardly opening interior area when the interior covering is connected to the lid portion; and a bar configured to be connected to a selected one of the sidewalls, together the bar, the base portion, the lid portion, and the roof assembly defining the bar structure when the lid portion is in the open position, the bar is connected to the selected sidewall, the interior covering is connected to the lid portion, and the at least one roof support supports the interior covering above the upwardly opening interior area, the bar being configured to be inside the closed container when the lid portion is in the closed position and the bar is disconnected from the selected sidewall.

14. The bar assembly of claim 13, further comprising:

a sink coupled to the base portion inside the upwardly opening interior area, the sink comprising a drain, the base portion comprising a drain outlet that is connected to the drain and configured to drain waste water from the sink; and a faucet positioned to provide water to the sink, the base portion comprising a water inlet that is connected to the faucet, the water inlet being configured to be connected to a water source, receive water from the water source, and provide the water to the faucet.

15. The bar assembly of claim 13, further comprising:

at least one electrical power outlet coupled to the base portion inside the upwardly opening interior area, the base portion comprising an electrical power inlet configured to receive electrical power from an electrical power source and provide the electrical power to the at least one electrical power outlet.

16. The bar assembly of claim 13, wherein the at least one roof support disassembles into components configured to be inside the closed container when the lid portion is in the closed position.

17. The bar assembly of claim 13, wherein the interior covering is configured to be placed on top of the lid portion when the lid portion is in the closed position.

18. The bar assembly of claim 13, wherein the base portion comprises a door configured to allow a user to enter and exit the upwardly opening interior area when the door is in an open position.

* * * * *